US010696087B1

(12) United States Patent
Maresh

(10) Patent No.: US 10,696,087 B1
(45) Date of Patent: Jun. 30, 2020

(54) WRITING INSTRUMENT

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 16/012,721

(22) Filed: Jun. 19, 2018

Related U.S. Application Data

(63) Continuation-in-part of application No. 15/866,430, filed on Jan. 9, 2018, now Pat. No. 10,300,733, which is a continuation-in-part of application No. 14/799,366, filed on Jul. 14, 2015, now Pat. No. 9,862,224.

(51) Int. Cl.

| | |
|---|---|
| ***B43K 5/18*** | (2006.01) |
| ***B43K 29/10*** | (2006.01) |
| ***B43K 8/02*** | (2006.01) |
| ***B43K 5/02*** | (2006.01) |
| ***B43K 7/02*** | (2006.01) |

(52) U.S. Cl.
CPC ..... *B43K 5/1827* (2013.01); *B43K 5/025* (2013.01); *B43K 7/02* (2013.01); *B43K 8/024* (2013.01); *B43K 29/10* (2013.01)

(58) Field of Classification Search
CPC ..... B43K 5/1827; B43K 5/025; B43K 7/02; B43K 8/024; B43K 29/10; B43K 7/10; B43K 5/10; B43K 5/14; B43K 5/145
See application file for complete search history.

(56) References Cited

U.S. PATENT DOCUMENTS 1,797,465 A * 3/1931 De Biasi ..... B43K 5/18 401/45
3,782,837 A * 1/1974 Feldmann ..... A46B 7/02 401/281

* cited by examiner

*Primary Examiner* — David J Walczak
(74) *Attorney, Agent, or Firm* — Nick A Nichols, Jr.

(57) ABSTRACT

A writing instrument may include an upper barrel rotatably connected to a lower barrel. Writing fluid reservoirs may be housed in the upper barrel. A writing tip secured to the lower barrel may be in selective fluid communication with the writing fluid reservoirs. The upper barrel may be rotatable relative to the lower barrel of the writing instrument.

13 Claims, 8 Drawing Sheets

WRITING INSTRUMENT

CROSS-REFERENCE TO RELATED APPLICATION

This application is a continuation-in-part of U.S. patent application Ser. No. 15/866,430, filed Jan. 9, 2018, which a continuation-in-part of U.S. patent application Ser. No. 14/799,366, filed Jul. 14, 2015, now U.S. Pat. No. 9,862, 224, which applications are herein incorporated by reference in their entirety.

BACKGROUND

The present invention relates to writing instruments, and in particular to writing instruments utilizing colored inks, pigments, and/or dyes in a suspended fluidic state.

Variable color writing instrument may include ball point pens with semi viscous ink, to pens with decreasing ink viscosity ranging from gel pens, roller ball pens, fountain pens, felt tip pens and the like. Applications may range from simple novelty reasons, to continuously blended color ink sketches, to more practical applications whereby a chronological indication may be given to a writing based upon the written word and the color of ink used. In endeavors which may involve skills, such as with color sketches, the ink colors throughout the sketch may be millions of colors, hues, and shades, and the user may create the sketch while controlling and anticipating the color(s) being blended and delivered to the writing tip. For example, while shades of yellow ink are delivered to the writing tip, the user may choose to sketch the sun or yellow objects, and as green ink is introduced, the user may sketch grass and green objects, etc.

In this sense, no two sketches would ever be the same. even if the act of sketching was exactly the same because color variation is inherently highly complex. In another example, notarizing documents or when dealing with legal matters, or even when writing a diary, the ink color of a writing may indicate the chronological order of such written words and the like. If insertions occur out of sequence, the color of such insertions may give an indication as to the general time period such insertions were made, and in this respect the use of color of ink may greatly assist in the prevention of improprieties and forgeries. It may be noted that re-blending an identical ink color would be very difficult, and thus forensic document examination may be greatly facilitated. Furthermore, in addition to ink, fluorescent dyes which fluoresce under ultraviolet light or other unusual lighting may be introduced into one or more of the ink colors, such that enhanced color graduations may be visible under UV light.

When dealing with writing fluids such as inks, paints, dyes, and/or pigments, subtractive color theory applies, as opposed to additive color theory where a light source passes through colored filters. Subtractive color theory is that of mixing inks, paints, dyes and/or other natural pigments to make colors that absorb and reflect particular wavelengths of light. For example, for printing, cyan, magenta, and yellow are primary colors. Black may be added for various reasons in a four-color process, most importantly because cyan, magenta, and yellow do not produce "pure" black but more of a dark gray.

Subtractive color theory is based on what light is absorbed. The amount of any color showing will depend on the amount of each of the three primary colors is in a color mixture. Cyan is the opposite of red. Magenta is the opposite of green. Yellow is the opposite of blue. The amount of blue in the final color mixture is directly related to the amount of yellow ink that is in the color mixture. The same is the case for other primary colors. For example, orange is a common color that is generally equal amounts of red and yellow. Adding more yellow will create a lighter orange. Adding red will create a red orange. Green color is a combination of cyan and yellow.

The subtractive color theory starts with the presence of all colors of light, usually as white light reflected from a white surface, such as paper. Dyes or inks may be used to subtract some of the reflected light. Understanding subtractive color theory requires an understanding of how colors of light are subtracted. If yellow dye or ink is applied on a white sheet of paper, one may think that color is added to the paper, but the color is already there; the white paper reflects all colors of light approximately equally. The yellow ink, however, reflects only red and green light and absorbs blue light, thereby subtracting it from the white light. Any color of ink, dye or paint subtracts its complementary color of light. Cyan ink on white paper absorbs red light, and allows green and blue to be reflected. Magenta ink subtracts green light, and allows red and blue to reflect. Yellow ink absorbs blue light, allowing red and green to reflect. Cyan, magenta and yellow are the subtractive primary colors, and combined in pairs, they produce the colors red, green and blue. When all three primary colors are subtractively combined, they subtract all colors of light, leaving black, typically a dark gray is the practical result.

When two primary colors are overlaid, they each subtract one color, allowing only the third color to be reflected. For example, if magenta and yellow ink are mixed or applied on white paper, the magenta ink absorbs green light. The yellow ink subtracts blue light. Neither of them absorbs red light, so red light is reflected by white paper, and a viewer sees the color red. In a sense, the colors experienced in a subtractive color mixture are created in the same way they're created with an additive mixture. A combination of red and green light (where the red and green colors each contain light from one-third of the spectrum) will always produce a yellow-colored light (containing light from two-thirds of the spectrum). It doesn't matter whether one starts with white light and subtracts one-third of the spectrum or starts with no light (black) and adds two thirds of the spectrum. Similarly, green and blue light always combine to produce cyan-colored light, and red and blue light always combine to produce magenta-colored light. Complementary colors work in similar ways for both additive and subtractive mixtures. In additive mixtures for example, yellow and blue light combine to complete the spectrum, producing white light. In subtractive mixtures, however, yellow and blue produce black (yellow and cyan produce green). Yellow ink subtracts one-third of the spectral light, blue ink subtracts the other two-thirds of the light, resulting in a black color. As previously noted, black is difficult to achieve in the subtractive process, and for that reason a four-color process may be desired in some situations in order to achieve a true black color.

In summary, the subtractive color system involves colorants and reflected light. Subtractive color starts with an object (often a substrate such as paper or canvas) that reflects light and uses colorants (such as inks, pigments or dyes) to subtract portions of the white light illuminating an object to produce other colors. If an object reflects all the white light back to the viewer, it appears white. If an object absorbs (subtracts) all the light illuminating it, no light is reflected back to the viewer and it appears black.

SUMMARY

A writing instrument may include an upper barrel rotatably connected to a lower barrel. Writing fluid reservoirs may be housed in the upper barrel. A writing tip secured to the lower barrel may be in selective fluid communication with the writing fluid reservoirs. The upper barrel may be rotatable relative to the lower barrel of the writing instrument.

In one instance an object of the writing instrument described herein is to provide a low-cost variable color writing instrument capable of full spectrum color.

In another instance an object of the writing instrument described herein is to maximize the words, characters and the like written with the writing instrument before refilling the writing fluid in the fluid reservoirs, and whereby, for example, a user may write substantially more words, characters and the like with a given amount of writing fluid, as compared to existing writing instruments.

In another instance an object of the writing instrument described herein is to provide a writing instrument of simple construction including a squeezable upper barrel for feeding writing fluid to the writing tip.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 3 is a second partial exploded perspective view of the writing instrument shown in

FIG. 1.

FIG. 5 is a second partial exploded perspective view of the writing instrument shown in

FIG. 4.

DETAILED DESCRIPTION

As used herein the term "fluid" means inks, paints, dyes, pigments, water, alcohol, mixing solutions, surfactants and other flowable fluids suitable for marking on a substrate material, such as paper and the like.

Figure 1:
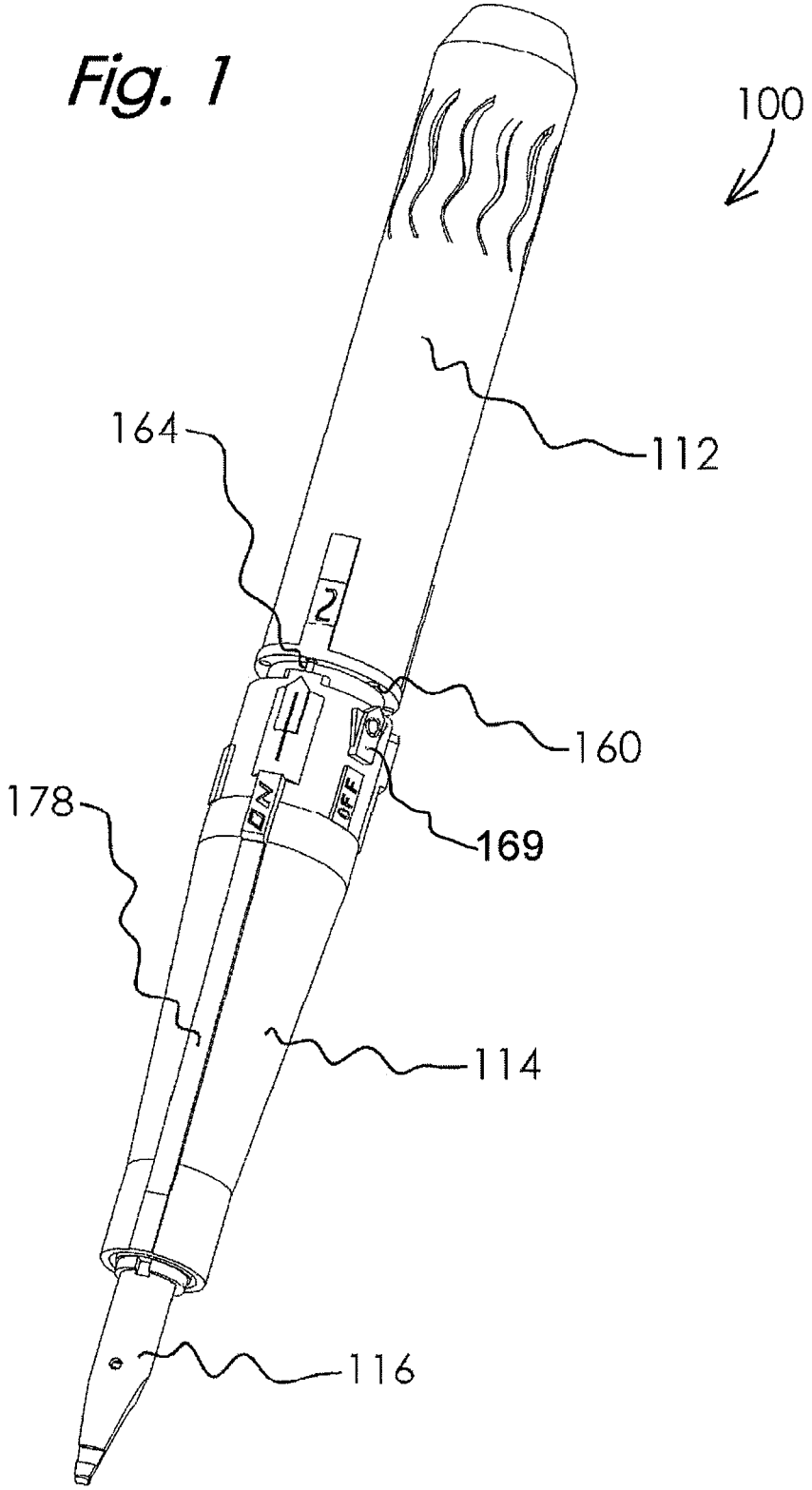
FIG. 1 is a perspective view of a writing instrument.
Figure 2:
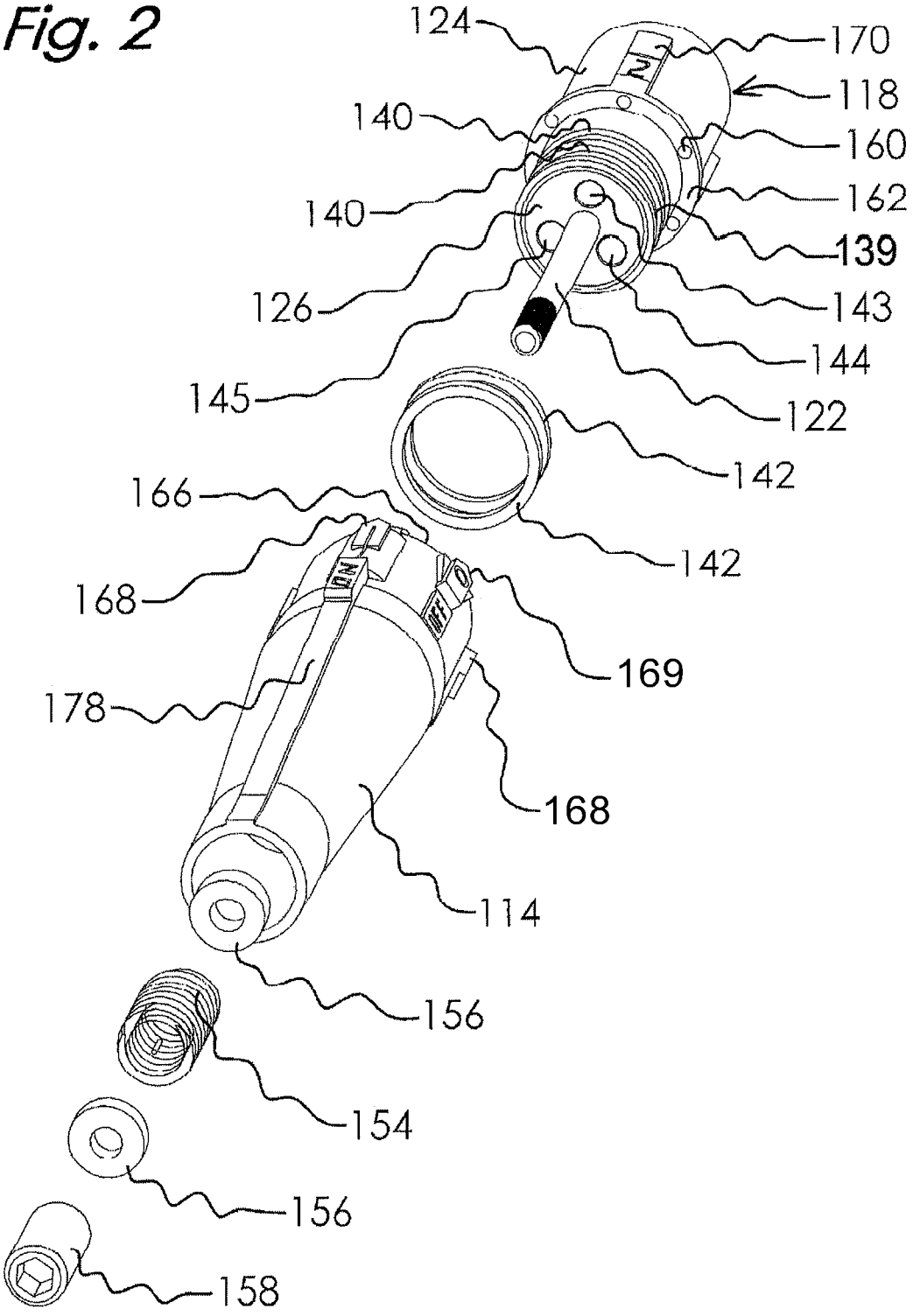
FIG. 2 is a partial exploded perspective view of the writing instrument shown in FIG. 1.

Referring first to FIG. 1, a writing instrument is generally identified by the reference numeral 100. For purposes of illustration, but not by way of limitation, the writing instrument 100 depicted in the drawings is a "fountain pen" and will hereinafter be referred to as a "pen."

The pen 100 may include an upper pen barrel 112 and a lower pen barrel 114 rotatably connected to one another. A writing nib 116 may be removably secured to the lower end of the lower pen barrel 114 in a manner known in the art. As noted above, the pen 100 is not limited to a "fountain pen" and therefore the writing nib 116 may comprise a ball point and/or roller ball point, as well as a felt tip wiring point and the like.

Figure 4:
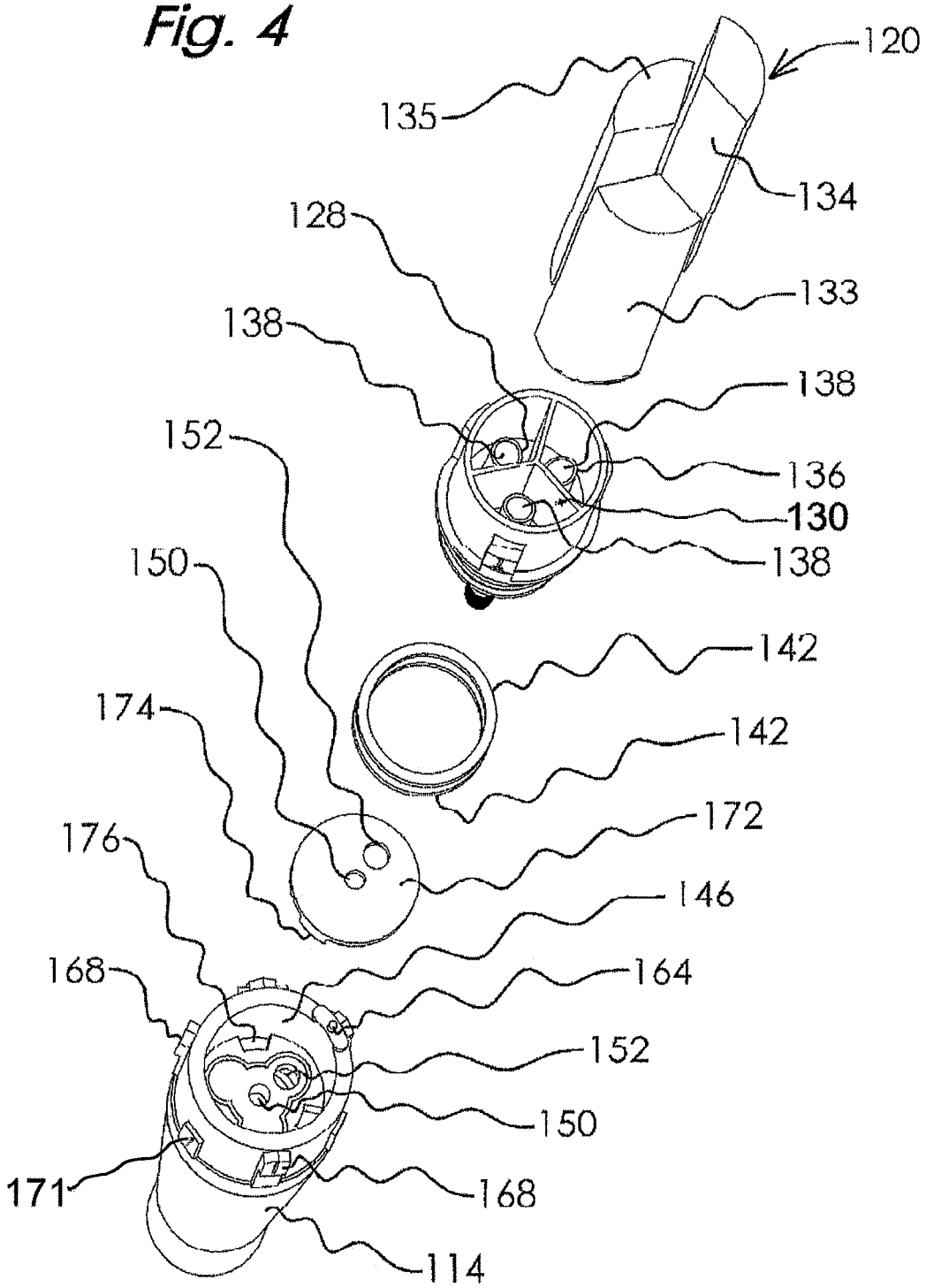
FIG. 4 is a partial exploded perspective view of a second embodiment of a writing instrument.

The upper pen barrel 112 may house a spool valve 118 and an ink cartridge 120 (shown in FIG. 4). An elongated spindle 122 may be fixedly secured to the spool valve 118. The spindle 122 may be coaxial with the longitudinal axis of the spool valve 118 and extend downward from a lower distal end of the spool valve 118.

An upper portion 124 of the spool valve 118 may form a spool cavity open at its upper end and closed at its lower end by a transverse bottom wall 128 (shown in FIG. 4). The spool cavity may be divided by wall members 130 extending upward from the transverse bottom wall 128 to form a plurality of chambers 132. The chambers 132 may include conduits 136 projecting upward from the bottom wall 128 of the spool cavity 125. The conduits 136 may define passageways 138 for directing ink from the ink reservoirs 133, 134, 135 to the lower pen barrel 114.

While three chambers 132 are depicted in the drawings, it is understood that the spool cavity may be divided to include fewer or a greater number of chambers 132 corresponding to the number of ink reservoirs 133, 134, 135 forming the ink cartridge 120. The inner profile of the chambers 132 may correspond to the outer profile or shape of the ink reservoirs 133, 134, 135 so that the ink cartridge 120 may be inserted and retained in the spool cavity by friction fit connection. The ink reservoirs 133, 134, 135 may each contain a unique ink color. The ink cartridge 120 may comprise an ink cartridge design sealed at the factory and reusable. A user may fill the ink reservoirs 133, 134, 135 with an eyedropper and the like. Alternatively, the ink cartridge 120 may be of a higher quality design with superior seals, provided to the user empty so that the user may fill the ink reservoirs 133, 134, 135 with ink colors selected by the user. The ink cartridge 120 may be installed by inserting the ink reservoirs 133, 134, 135 into respective chambers 132 onto the conduits 136 and sealed therewith by friction connection between the conduits 136 and respective reservoirs 133, 134, 135.

The spool valve 118 may include a reduced diameter lower portion 139 terminating at a transverse bottom wall 126. The reduced diameter portion 139 may include circumferential grooves 140 for receiving o-rings 142 which may slidably engage with an inner surface of a recessed cavity 146 of the lower pen barrel 114. The o-rings 142 may provide a secondary seal in the event that any ink weeps out and moves along the spool valve 118. However, the o-rings 142 may be omitted if close tolerances are maintained during manufacturing. In any event, one or more o-rings 142 may provide an additional barrier to prevent ink leakage. The ink passageways 138 formed by the conduits 136 may terminate at respective outlet holes 143, 144, 145 in the bottom wall 126 of the reduced diameter portion 139 of the spool valve 118.

Figure 3:
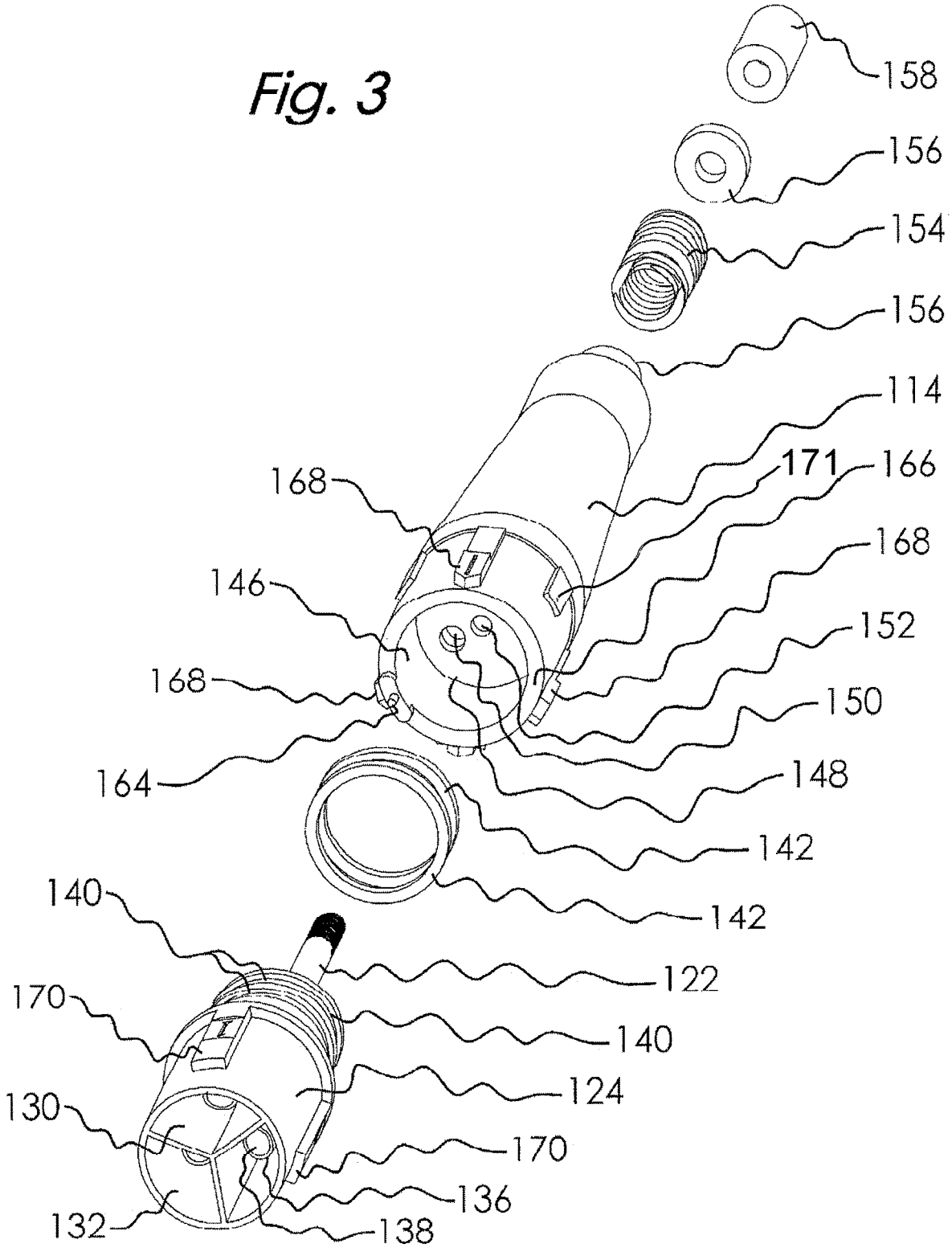

Referring now to FIG. 3, the lower pen barrel 114 may be configured for mating engagement with the spool valve 118. The upper distal end of the lower pen barrel 114 may define a recessed cavity 146. The bottom of the cavity 146 may be a transverse planar seal 148. The seal 148 may be a "poured in place" seal, such as silicone and the like. The seal 148 may include a spindle hole 150 and an ink pathway port 152 radially offset from the spindle hole 150. Upon assembly of the spool valve 118 with the lower pen barrel 114, the spindle 122 extends through the spindle hole 150 and the reduced diameter lower portion 139 of the spool valve 118 is received in the cavity 146 of the lower pen barrel 114. A spring 154 disposed between washers 156 may be threaded on the spindle 122. A cap nut 158 may be threaded on the spindle 122 and tightened to compress the spring 154 and thereby provide a compressive biasing force against the seal 148 forcing it into facing contact with the bottom wall 126 of the lower portion 139 of the spool valve 118. Typically, the spring 154 may limit and regulate the compressive force at the seal 148 to about 5-10 pounds to ensure a liquid tight rotary connection.

It may be observed that the seal 148 includes a single ink pathway port 152. Ink may be directed to the writing nib 116 by aligning outlet holes 143, 144, 145 in the bottom wall 126 of the spool valve 118 with the ink pathway port 152 by rotating the spool valve 118 relative to the lower pen barrel 114. Detents 160 may be provided in the circumferential shoulder 162 circumscribing the reduced diameter lower portion 139 of the spool valve 118 for accurate alignment of the ink pathway port 152 with any one of the outlet holes 143, 144, 145 of the spool valve 118. The detents 160 may be engaged by a spring-loaded pin 164 fixedly secured to the upwardly facing distal edge 166 of the lower pen barrel 114.

The detents 160 may be arranged about 60° degrees apart so that a tactile and audible indication may be provided at every 60° degrees of rotation of the spool valve 118 relative to the lower pen barrel 114. As there may be periods of time, such as when the pen 100 is not in use or is in transport, it may be desirable to shut off the supply of ink to the writing nib 116. As the outlet holes 143, 144, 145 in the spool valve 118 are equally spaced apart, about 120° degrees, every 60° degrees of rotation of the spool valve 118 relative to the lower pen barrel 114 will either align one of the outlet holes 143, 144, 145 with the ink pathway port 152 or misalign with the ink pathway port 152, and thereby ensure that the flow of ink to the writing nib 116 is shut off. As each detent 160 aligns with the spring-loaded pin 164 a "click" may be heard indicating that ink flow to the writing nib 116 is "on" or "off."

A visual indication as to whether the pen 100 is in the "on" or "off" position may also be provided. Alignment tabs may be fixedly secured about the periphery of the lower pen barrel 114 proximate the distal edge 166 thereof. Upon alignment of the "on" tab 168 with one of the indicators 170 fixedly secured about the periphery of the upper portion 124 of the spool valve 118, the selected ink color may flow through a respective passageway 138 to the writing tip 116. The indicators 170 may be aligned with the detents 160 corresponding to the "on" or ink flow position. The indicators 170 may be labeled to indicate the corresponding ink reservoir 133, 134, 135 associated with the respective indicator 170. For example, but without limitation, the indicators 170 depicted in the drawings may be labeled "1," "2," and "3" to identify the respective ink reservoirs 133, 134, 135. The user may then easily determine whether a particular ink color in the ink reservoirs 133, 134, 135 is aligned for delivery to the writing nib 116.

When the pen 100 is not in use, one of the indicators 170 may be aligned with an "off" tab 169 fixedly secured about the periphery of the lower pen barrel 114. In the "off" position the ink passageways 138 are misaligned with the ink pathway port 152 so that the flow of ink to the writing nib 116 may be blocked. A tab 171 fixedly secured about the periphery of the lower pen barrel 114 may correspond to position of the lower pen barrel 114 relative to the to the spool 118 where the ink pathway port 152 is always blocked.

Figure 5:
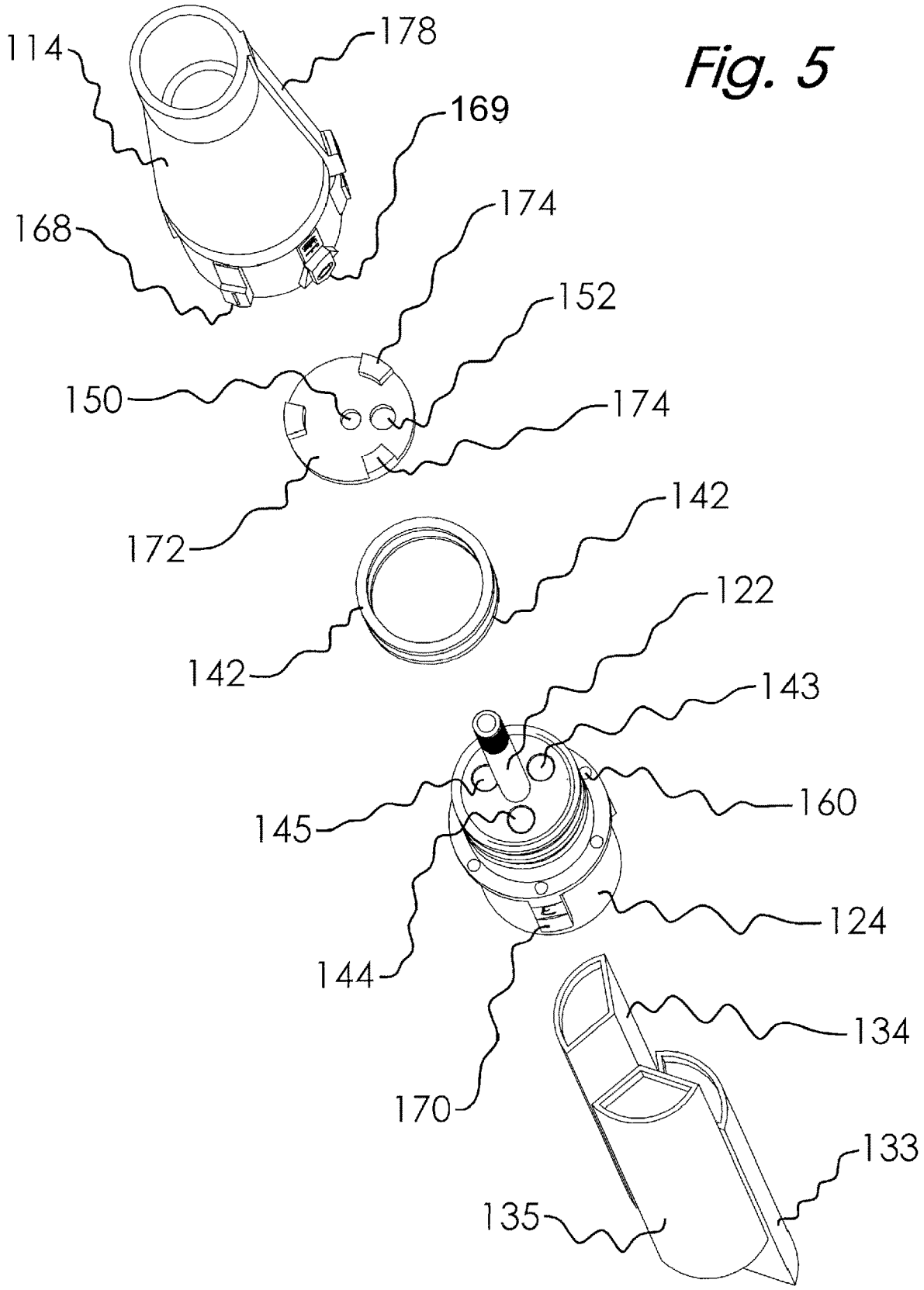

Referring now to FIGS. 4 and 5, an alternate embodiment of the pen 100 may include a seal disc 172 which is pre-molded or cast to the appropriate shape to fit in cavity 146 of the lower pen barrel 114. The seal disc 172, may for example, be 60 Shore A silicone, or a cast and polished ceramic material. The seal disc 172 may include a spindle hole 250 and an ink pathway port 252 radially offset from the spindle hole 250. The seal disc 172 may be provided with various contours, including bosses 174, or splines and the like so that when installed the seal disc 172 does not rotate relative to the lower pen barrel 114. For example, but without limitation, the bottom wall of the recessed cavity 146 may be provided with recesses 176 so that the bosses 174 may nest therein and secure the seal disc 172 in the cavity 146 of the lower pen barrel 114.

The lower pen barrel 114 may include a ridge 178 on the exterior surface thereof. The ridge 178 may be generally oriented upward to facilitate downward flow of ink and upward passage of air as the ink in each of the reservoirs 134 is consumed and displaced with air. The orientation of the ridge 178 may not be of consequence for ball point pen designs and inks having a relatively higher viscosity.

Figure 6:
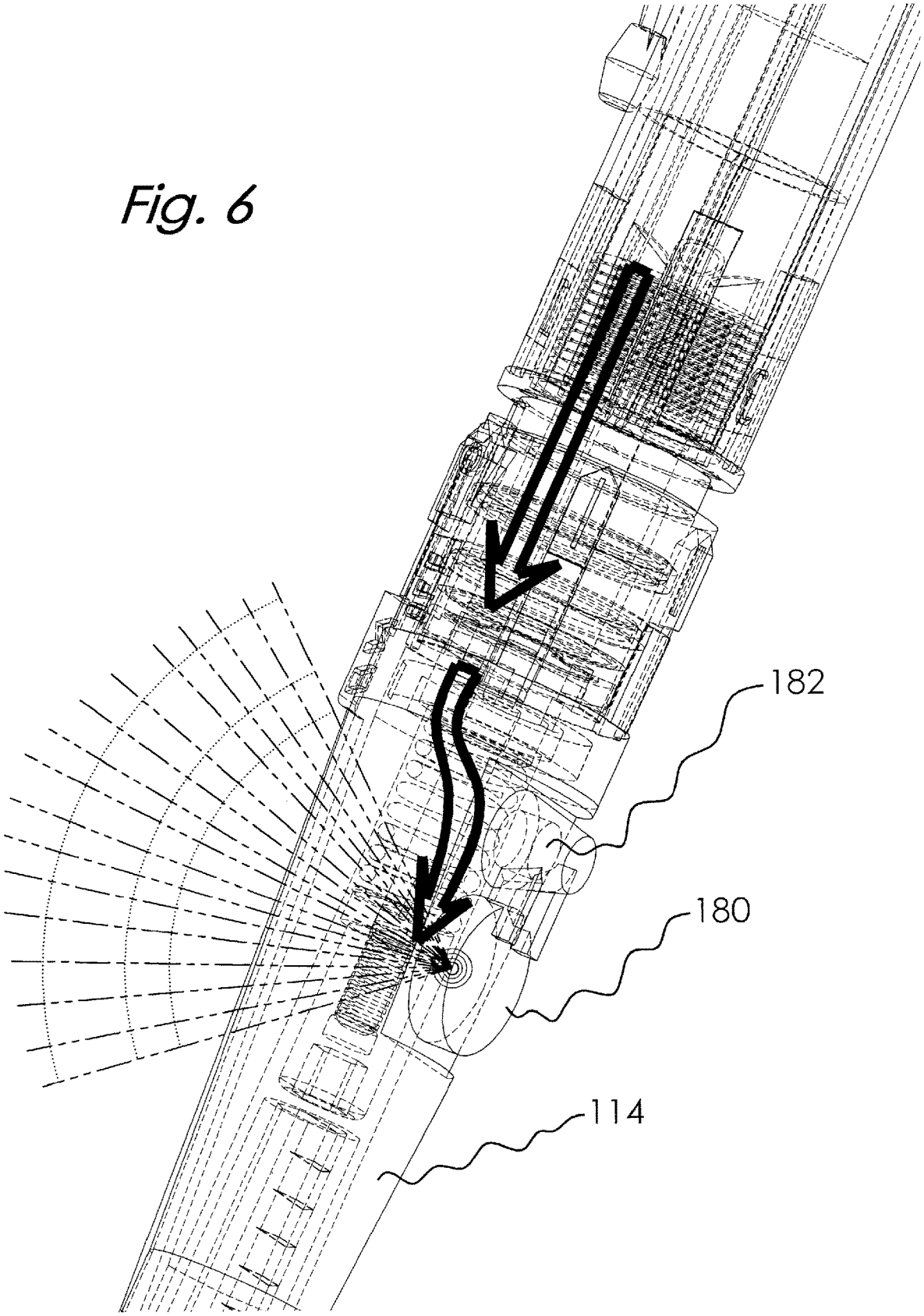
FIG. 6 is a partial perspective view of a writing instrument showing hidden lines and a viewing portion of the writing instrument.
Figure 7:
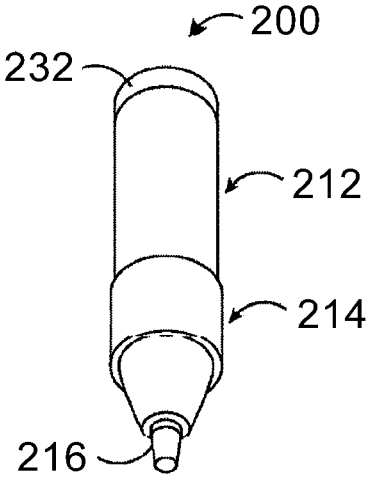
FIG. 7 is a perspective view of a third embodiment of a writing instrument.
Figure 8:
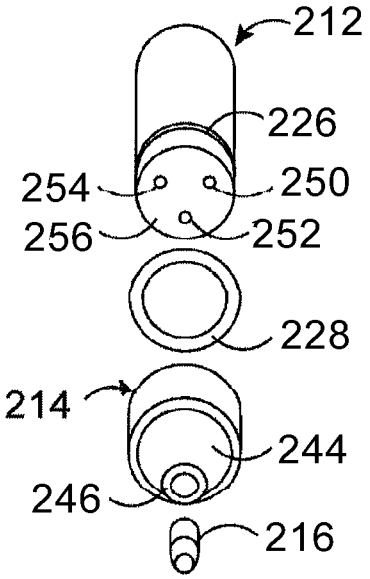
FIG. 8 is an exploded perspective view of the writing instrument shown in FIG. 7.

Referring now to FIG. 6, the lower pen barrel 114 of the pen 100 may include a transparent portion. An LED light 180 and a battery 182 may be imbedded in the transparent portion of the lower pen barrel 114. The light 180 may illuminate the region of the lower pen barrel 114 where mixing of the ink colors may occur, thereby permitting the user to view the color of the ink mixture flowing toward the writing nib 116.

The pen 100, as noted above and depicted in the drawings, is a fountain type pen for illustrative purposes only. It is understood that the pen 100 described herein may include, but is not limited to, ball point pens with viscous ink (considered paste), pens with generally decreasing ink viscosity ranging from tempura pens, gel pens, roller ball pens, brush tip pens, fountain pens, stylus pens, and/or felt tip pens, of both water or alcohol base and the like.

The pen 100 may be suitable for a wide range of uses such as a simple novelty item to being able to continuously and smoothly cause a transition of colors while creating a drawing, sketch and the like, and where no two sketches or drawings are identical, even with identical pen motions, because of the somewhat turbulent flow and the complex nature of the physics of a flowing fluid. Viscosity alone is a complex and somewhat chaotic factor to consider, as well as the dynamics of the spool valve or other valves, such as disk valves or pinch valves.

The subtractive color system, described in greater detail hereinabove, applies to the pen 100. The full color spectrum may be possible with the ink colors magenta, yellow, and cyan. Generally, pen 100 may be considered a "color shifting pen" utilizing three reservoirs (or three cartridge) of compatible or mixable inks. Color shifting pens may be controlled with the spool valve described hereinabove. The pen 100 may be used for various purposes, such as, notarizing documents or dealing with legal matters, or even writing a diary. The chronological order of the written words, characters and the like may be determined by the ink color. If insertions occur out of sequence, the color of such insertions provides an indication as to the general time period, based upon the ink color, that such insertions were made. In this respect, the use of color may greatly assist in the prevention of fraud and forgeries. Note that it would be very difficult to re-blend the identical ink color. Forensic document examination may also be greatly facilitated. The reader will note that the chronological order is not actually a function of time, but rather a function of the number of words, characters and the like the pen has written. Furthermore, in addition to ink, fluorescent dyes which fluoresce under ultraviolet light may be introduced into one or more of the reservoirs, for example, in order to introduce unique graduations which would only be visible under UV light.

Continuing again with ink mixtures, the ink colors throughout a sketch, drawing or writing are a smooth transition of many colors, hues, and shades. A user may create the sketch or drawing while controlling and anticipating the colors being mixed and/or blended and delivered to the writing tip. For example, while shades of yellow are being delivered to the writing tip, the sun or yellow objects may be sketched, and as the user introduces green blended ink, then plants and/or green objects may be sketched. Furthermore, during color mixing, and particularly when utilizing fountain pens, it should be noted that the quantity of ink colors available in the market is high, and the user may elect to deviate from the three subtractive primary colors discussed above and select non-primary colors which, for example, may result in mixtures of pastel colors. Alternatively, scarlet, purple and/or green ink may be included in at least one of the reservoirs to emphasize a particular mixable range of colors. Also, for steady delivery of a mixed color or shade, positioning the spool valve to a predetermined intermediate position between two fluid reservoirs, both in the "on" mode in some portion (throttling), steady state mixing action may occur while writing.

All colors are possible with the three-reservoir configuration of the pen 100 where the primary subtractive colors are provided. With regard to secondary colors, if the primary subtractive colors of yellow, cyan, and magenta are provided, then a secondary color such as red, green or blue may be mixed and delivered to the pen mixing chamber, and once such a color is in the mixing chamber, a new primary color may be introduced resulting in colors such as violet, rose, orange, chartreuse green, spring green, and azure to be mixed within the pen mixing chamber and thereafter delivered to the writing tip. Further variations when combining tertiary and secondary colors, or tertiary and tertiary colors, or any combination of the above colors are also possible, thus enabling a remarkably wide variation of the number of colors, shades and hues which may be gradually mixed within the pen mixing chamber during the act of writing.

Referring now to FIGS. 7-10, a third embodiment of a writing instrument is generally identified by the reference numeral 200. The writing instrument 200 may include an upper barrel 212 and a lower barrel 214. The upper barrel 212 and lower barrel 214 may be rotatable relative to one another. A writing nib 216 may be removably secured to the lower end of the lower barrel 214 in a manner known in the art. The writing nib 216 may, for example but without limitation, be a removable sponge or a brush type material typically used for tempura paint which is non-toxic and suitable for use by children.

For purposes of illustration, but not by way of limitation, the writing fluid in the writing instrument 200 will hereinafter be referred to as "paint," it being understood however that the writing fluid may include inks, paints, dyes, pigments, water, alcohol, mixing solutions, surfactants and other flowable fluids suitable for marking on a substrate material, such as paper and the like.

Figure 9:
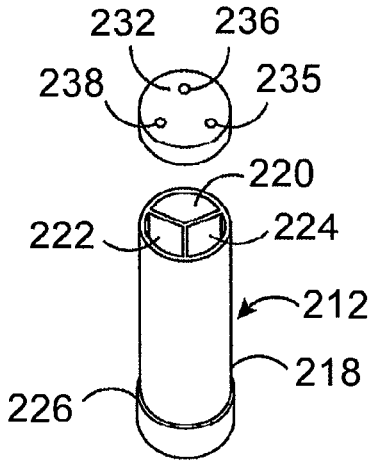
FIG. 9 is an exploded perspective view of the upper barrel and cap of the writing instrument shown in FIG. 7.

The upper barrel 212 may include a cylindrical shaped body 218, best shown in FIG. 9. For purposes of illustration, the upper barrel 212 may include three paint reservoirs 220, 222 and 224. Those skilled in art will recognized that the upper barrel 212 may include fewer or greater number of paint reservoirs to hold multiple paint colors. The upper barrel 212 may be fabricated of pliable material, such as but without limitation, plastic. The body 218 of the upper barrel 212 may be squeezed to feed a paint color to the writing nib 216. A circumferential first groove 226 may extend about the body 218 proximate a lower end thereof. The first groove 226 may receive an o-ring 228 which may also be cooperatively received in an interior circumferential second groove 230 formed proximate of transverse wall 242 extending across the lower barrel 214. Upon assembly of the upper barrel 212 with the lower barrel 214, the grooves 226, 230 are in facing relationship defining a circumferential channel therebetween. The o-ring 228 may be seated in the channel formed by the grooves 226, 230 and prevent axial movement of the upper barrel 212 relative to the lower barrel 214. While the upper barrel 212 and lower barrel 212 may be separated upon application of a pulling force to the upper barrel 212, the o-ring 228 prevents inadvertent separation of the upper and lower barrels 210, 212. Alternatively, but without limitation, the o-ring 228 may form a sliding seal with a smooth inner surface of the lower barrel 214.

Referring still to FIG. 9, the upper end of the upper barrel 212 may be closed by a removable cap 232 which may be pressed or threaded on the upper barrel 212. The cap 232 may include flapper check valves 234, 236 and 238, one for each of the paint reservoirs 220, 222, 224, or alternatively one larger check valve to cover all three paint reservoirs 220, 222, 224. The check valves may prevent creating a vacuum in the paint reservoirs when squeezed to feed paint to the writing nib 216. When the squeezing force is released, air may enter the reservoirs through the check valves and replace the displaced paint, thereby preventing the creation of a vacuum in the paint reservoirs.

Figure 10:
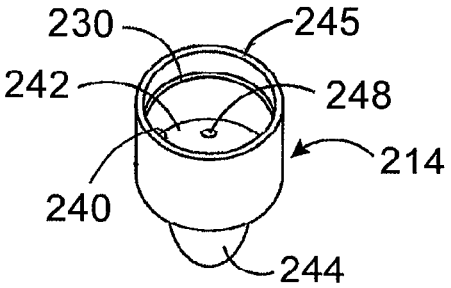
FIG. 10 is a perspective view of the lower barrel of the writing instrument shown in FIG. 7.

Referring now to FIG. 10, the lower barrel 214 may include a cavity 240 configured in size and shape to receive the lower end of the upper barrel 212 therein. The cavity 240 may extend from an open proximal end 245 of the lower pen barrel 214 to a transverse wall 242 extending across the lower pen barrel 214. A nozzle 244 may extend downward from the transverse wall 242. The nozzle 244 may be configured in the shape of a cone to facilitate the movement of paint toward the writing nip 216 which may be removably attached to a nozzle tip 246 of the nozzle 244.

The transverse wall 242 may include an opening 248 radially offset from a center axis of the transverse wall 242. The opening 248 may define an ink pathway port to the nozzle portion 244 of the lower barrel 214. The opening 248 may align with a paint reservoir hole 250, 252, 254 formed in the bottom wall 256 of the upper barrel 212. Upon assembly, the upper barrel 212 may be pressed into the lower barrel 214 so that the bottom wall 256 of the upper barrel 212 is in facing contact with the transverse wall 242 of the lower barrel 214. The upper and lower barrels 212, 214 may be rotated or twisted relative to one another to align the opening 248 with one of the holes 250, 252, 254 which define an outlet port for a respective paint reservoir 220, 222, 224. Squeezing the upper barrel 212 forces the selected color of paint from the reservoir 220, 222, 224 aligned with the inlet port 248 into the nozzle portion 244 and to the writing nib 216.

While various embodiments of the invention have been shown and described herein, other and further embodiments of the invention may be devised without departing from the basic scope thereof, and the scope thereof is determined by the claims which follow.

The invention claimed is:

1. A writing instrument, comprising:

a) an upper pen barrel and a lower pen barrel rotatably connected to one another, wherein said lower pen barrel includes a cavity extending from an open proximal end of said lower pen barrel to a transverse wall extending across said lower pen barrel;

b) a writing nib removably secured to said lower pen barrel;

c) said upper pen barrel including an elongated pliable body so as to enable a user to manually compress said body during use, wherein said pliable body includes a plurality of paint reservoirs in fluid communication with said writing nib such that when said body is manually compressed by a user, paint will flow from at least one of said reservoirs; and d) said lower pen barrel including an ink pathway port, wherein rotation of said upper pen barrel relative to said lower pen barrel aligns a respective one of said plurality of paint reservoirs with said ink pathway port.

2. The writing instrument of claim 1 wherein said upper pen barrel is fabricated of pliable material, each said plurality of paint reservoirs including an outlet opening.

3. The writing instrument of claim 2 wherein said lower pen barrel includes a nozzle extending downward from said transverse wall.

4. The writing instrument of claim 3 wherein said ink pathway port is radially offset from a center axis of said transverse wall.

5. The writing instrument of claim 1 wherein said upper pen barrel includes a circumferential first groove proximate a lower end of said upper pen barrel.

6. The writing instrument of claim 5 including an o-ring received in said first groove of said upper pen barrel.

7. The writing instrument of claim 6 wherein said lower pen barrel includes a circumferential second groove proximate said transverse wall of said lower pen barrel, said first groove and said second groove in opposed facing relationship to form a circumferential channel for receiving said o-ring.

8. The writing instrument of claim 1 wherein said upper pen barrel includes a removable cap, said cap including a check valve.

9. The writing instrument of claim 1 wherein said upper pen barrel includes a removable cap, said cap including a plurality of check valves actuable to provide an air inlet to a respective said plurality of paint reservoirs.

10. A writing instrument, comprising:

a) an upper pen barrel and a lower pen barrel rotatably connected to one another;

b) a writing nib removably secured to a lower distal end of said lower pen barrel;

c) said upper pen barrel including a plurality of paint reservoirs in fluid communication with said writing nib, each said plurality of paint reservoirs including an outlet port;

d) a cap removably secured to said upper pen barrel, said cap including at least one check valve; and e) said lower pen barrel including an ink pathway port, wherein rotation of said upper pen barrel relative to said lower pen barrel aligns said outlet port of a respective one of said plurality of paint reservoirs with said ink pathway port.

11. The writing instrument of claim 10 wherein said cap includes a plurality of check valves actuable to provide an air inlet to a respective said plurality of paint reservoirs.

12. The writing instrument of claim 10 wherein said upper pen barrel includes an elongated squeezable body.

13. The writing instrument of claim 10 wherein said lower pen barrel includes a cavity extending from an open distal end of said lower pen barrel to a transverse wall extending across said lower pen barrel, said upper pen barrel including a first circumferential groove, said lower pen barrel including a second circumferential groove, said first groove and said second groove in facing relationship with one another defining a circumferential channel, and further including a sliding seal received in said channel.

* * * * *